US008600092B2

(12) United States Patent
Parraga Gimeno et al.

(10) Patent No.: US 8,600,092 B2
(45) Date of Patent: Dec. 3, 2013

(54) TELESCOPIC LOUDSPEAKER

(75) Inventors: Javier Parraga Gimeno, Madrid (ES); Qi Zhang, Shenzhen (CN)

(73) Assignee: Woxter Technology Co., Ltd., Causeway Bay (HK)

( * ) Notice: Subject to any disclaimer, the term of this patent is extended or adjusted under 35 U.S.C. 154(b) by 0 days.

(21) Appl. No.: 13/505,208

(22) PCT Filed: Oct. 30, 2009

(86) PCT No.: PCT/ES2009/000521
§ 371 (c)(1),
(2), (4) Date: Jul. 20, 2012

(87) PCT Pub. No.: WO2011/051505
PCT Pub. Date: May 5, 2011

(65) Prior Publication Data

US 2013/0129134 A1 May 23, 2013

(51) Int. Cl.
*H04R 1/02* (2006.01)
*H04R 1/28* (2006.01)

(52) U.S. Cl.
CPC ..... *H04R 1/2803* (2013.01); *H04R 1/02* (2013.01); *H04R 1/021* (2013.01); *H04R 1/026* (2013.01)
USPC ..... 381/338; 381/345; 381/351

(58) Field of Classification Search
USPC ..... 381/87, 332, 337, 338, 345, 351, 381/386–389; 181/143–144, 157, 160, 166, 181/198, 199
See application file for complete search history.

(56) References Cited

U.S. PATENT DOCUMENTS 4,574,906 A * 3/1986 White et al. ..... 181/145
7,218,746 B2 * 5/2007 Schmidt et al. ..... 381/334

FOREIGN PATENT DOCUMENTS

| | | |
|---|---|---|
| CN | 2907146 | 5/2007 |
| CN | 200966127 | 10/2007 |
| CN | 200997670 | 12/2007 |
| CN | 201063854 | 5/2008 |
| CN | 201146589 | 11/2008 |
| FR | 2 680 295 | 2/1993 |
| GB | 2 245 798 | 1/1992 |

OTHER PUBLICATIONS

International Search Report for International Application No. PCT/ES2009/000521 mailed Jun. 15, 2010.

* cited by examiner

*Primary Examiner* — Tuan D Nguyen
(74) *Attorney, Agent, or Firm* — Merchant & Gould P.C.

(57) ABSTRACT

A telescopic loudspeaker includes an extendable telescopic body (1) responsible for housing a loudspeaker (2) for generating sound from a input audio signal and for creating a inner resonance chamber (2) of volume V0 when the telescopic body (1) is retracted and of volume V1 when the telescopic body (1) is extended, V1>V0 being met. The telescopic body (1) includes a support base (15); of hollow bodies (11,12,13) with decreasing transversal sections and coupleable to one another, the section decreasing progressively from the body (11) closest to the base (15) up to the body (13) furthest from the base (15); and a gasket (8) between each pair of consecutive bodies (11,12,13) of the telescopic body (1) for sealing the air chamber inside the enclosure of the telescopic loudspeaker.

15 Claims, 4 Drawing Sheets

TELESCOPIC LOUDSPEAKER

This application is a National Stage Application of PCT/ES2009/000521, filed 30 Oct. 2009 and which application is incorporated herein by reference. To the extent appropriate, a claim of priority is made to the above disclosed application.

FIELD OF THE INVENTION

The present invention is encompassed within the field of the loudspeakers for the connection thereof with any audio device. More specifically and due to their special characteristics, the present invention relates to a telescopic loudspeaker.

BACKGROUND OF THE INVENTION

Loudspeakers especially those of the portable type allowing the user to carry them with him/her and to connect them to other devices such as MP3 players, mobile telephones, portable computers, PCs or any other device capable of playing audio are widely known in the state of the art.

There are various types of loudspeakers on the market having different specifications depending on the shape thereof and the housing used. There are numerous published studies describing the effect of different housing materials and shapes and of how it affects the sound quality of the loudspeaker. However, for portable use for example, only one type of small loudspeakers with closed casing which only offer one sound range and a reduced acoustic power due to the fact that the shape cannot be changed, is traditionally used.

The present invention describes a loudspeaker which allows increasing the acoustic spectrum and increasing the sound quality of the loudspeaker by means of the dynamic change of the shape of the casing of the loudspeaker which allows increasing the inner volume and thus achieving more low-pitch (sounds at low frequencies) and more intense sounds increasing the resonance box of the volume of the loudspeaker, maintaining in turn the stiffness of the acoustic body (improving high and medium frequencies) and increasing the resonance cavity within the loudspeaker in a clear and linear manner without internal interferences, therefore increasing the acoustic power and achieving improved sound. All this is achieved by means of the telescopic system incorporating the loudspeaker of the present invention known as Microbeat.

The present invention solves all the previous drawbacks by providing a loudspeaker which can be portable and which can be retracted forming a body of reduced dimensions whereas during its use it can be extended, having a larger resonance chamber undeformable against use or outside actions whereby the acoustic power is increased and the sound quality is improved.

DESCRIPTION OF THE INVENTION

The present invention relates to a loudspeaker of any size which can be portable and which allows improving the sound quality emitted by being able to increase its total volume and therefore its inner air chamber or resonance volume, at the same time maintaining the stiffness of the volume of the loudspeaker at all times which improves the resonance quality inside the same and therefore also improves the sound quality, further increasing its power.

The body of the loudspeaker is formed by an extendable casing wherein the loudspeaker used for emitting the sound is located. The extendable casing of the loudspeaker is telescopic which allows creating an inner resonance chamber when the casing is extended.

Due to its special configuration, the loudspeaker, when not being used can be retracted forming a body of reduced dimensions allowing the user to transport it with great ease, whereas when it is in use increases its volume and maintains, however, its structural stiffness.

The loudspeaker is located inside the mobile free end of the telescopic casing whereby it leaves all the inner space of the casing free so that it acts as a resonance chamber.

The main body of the casing is formed by a plurality of parts (at least two) which are coupled to one another, one inside the other in a manner parallel to the extension shaft of the complete body formed between them. These parts can have a transversal section of any shape. The outermost part and the innermost part are closed by a surface preferably transversal to the extension shaft. The loudspeaker will be considered closed when the distance separating these surfaces transversal to the extendable shaft reach a minimum value, and it will be considered open when the distance thereof reaches its physically possible maximum value, i.e., maintaining the inner air volume closed.

The loudspeaker will preferably be arranged in any (or in both) transversal surfaces closing the external shape, such that when the body of the loudspeaker is open the inner volume of the loudspeaker is greater than when it is closed or retracted, which improves the sound range and power as has already been indicated. This volume change is performed by always maintaining the stiffness of the body of the loudspeaker which allows increasing its acoustic quality. The telescopic loudspeaker of the present invention allows increasing the volume easily by more than 200% of the initial volume when the loudspeaker is retracted.

If two loudspeakers are coupled in the two surfaces it would be possible to develop a single stereo system of dynamic volume.

This invention allows the configuration of the inner cavity to have straight shapes preventing interferences in the reflected wave of inner sound, allowing the inner resonance cavity of the loudspeaker to increase the sound effects, especially the low frequency sound (low-pitch sounds around 100 Hz-250 Hz) even reinforcing the medium and high tones (medium and high audible frequencies 1000 Hz-20000 Hz).

Both while being closed and extended, the loudspeaker can be magnetically coupled to any metal or ferromagnetic surface, even to another loudspeaker.

By means of the connection of the loudspeakers by a simple connection cable any number of loudspeakers can be coupled multiplying the simultaneous sound capacity thereof as a sole sound source.

BRIEF DESCRIPTION OF THE DRAWINGS

A series of drawings which aid in better understanding the invention and are specifically related to an embodiment of said invention presented as a non-limiting example will be described briefly below.

DETAIL DESCRIPTION OF THE INVENTION

Figure 1:
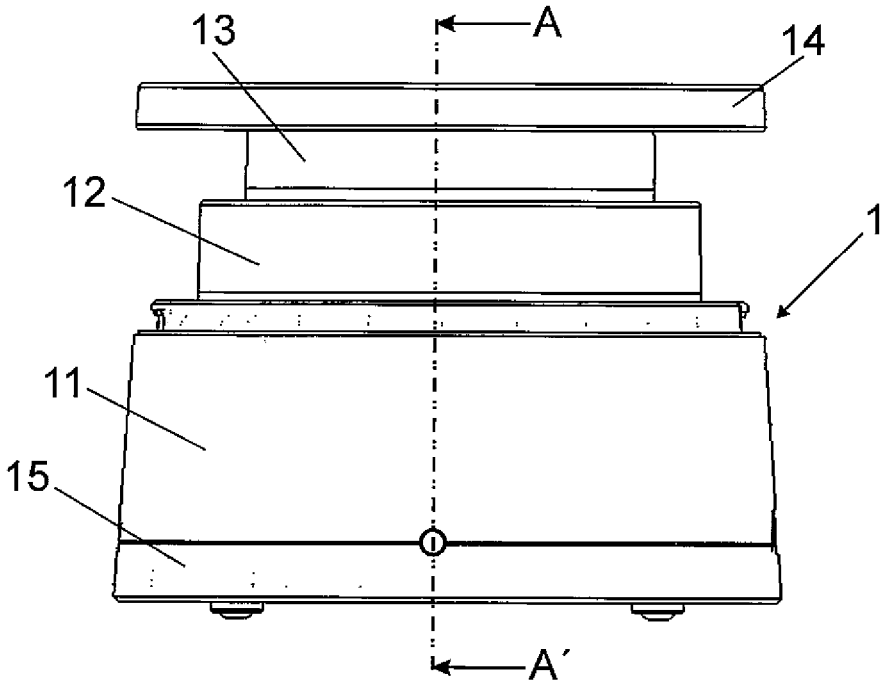
FIG. 1 shows an elevational view of the loudspeaker of the present invention in extended arrangement.
Figure 2:
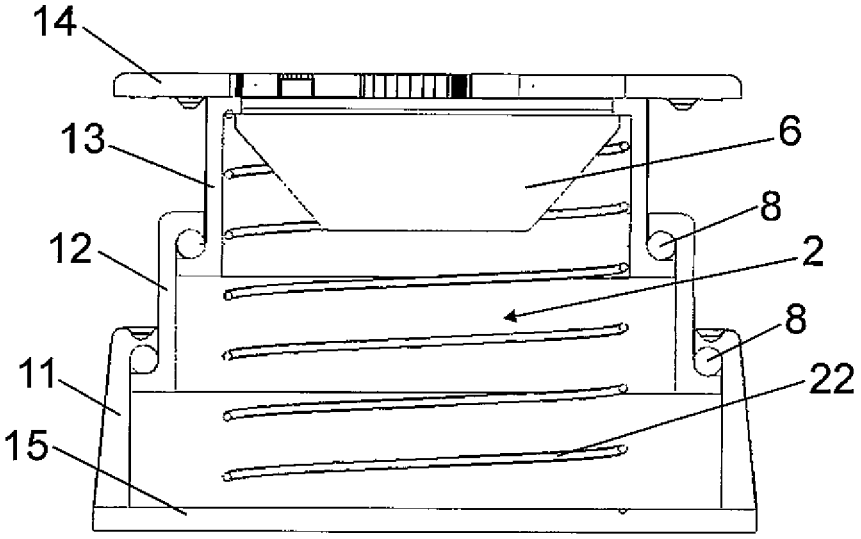
FIG. 2 depicts a cross-section view according to the cutting lines AA' indicated in FIG. 1, the loudspeaker being in extended position.

FIG. 1 shows an embodiment, by way of a non-limiting example, of the present invention. The loudspeaker proposed by the present invention has an extendable casing 1 in the inside of which the loudspeaker used for emitting the sound is placed, this configuration is especially applicable to the portable loudspeaker design. The extendable body 1 of the loudspeaker is telescopic formed by a base 15, three concentric bodies (11,12,13) of decreasing sections and coupleable to one another, the section decreasing progressively from the body 11 closest to the base 15 up to the body 13 furthest from the base 15, and by a cover or seal 14 connected with the body 13 of the casing of smaller section (the furthest from the base). The loudspeaker 6 is incorporated inside the casing 1, preferably attached inside the body 13 furthest from the base 15 such as shown in FIG. 2, simplified cross-section view AA' (showing only the bodies (11,12,13), the spring 22 and the loudspeaker 6), although it could also be attached to the cover 14 (the loudspeaker 6 is thus attached to a plane transversal to the extensor shaft). This configuration allows increasing the resonance cavity or chamber 2, maintaining the stiffness of the cavity of the loudspeaker. Regardless of whether the extendable casing is retracted or extended, there is a closed leak-tight enclosure inside the loudspeaker forming the resonance chamber 2. The closed enclosure forming the resonance chamber 2 can be exclusively formed by the set of the bodies (11,12,13) together with the loudspeaker 6, but the cover 14 and the base 15 can also intervene in the closing of the inner enclosure.

As seen in FIG. 2, the extendable casing 1 is of telescopic type having, for example, a spring 22 (other attachment systems could be used) which allows maintaining the extendable casing 1 in an extended position (the loudspeaker in operating position). In the case of using a spring as an attachment system, the later must have a spring constant or stiffness K large enough as to provide a good leak-tightness to the loudspeaker in extended position which influences the sound quality obtained (with greater leak-tightness better sound quality). Said minimum spring constant K will mainly depend on the structure of the loudspeaker and on the material/materials used and could be obtained through experimentation.

In this example, the casing 1 has a fixed body and two moveable bodies (12,13) which can be extended or retracted. The loudspeaker is in the use position when the movable bodies (12,13) of the casing 1 are extended for obtaining a greater acoustic power. To facilitate the transport of the loudspeaker, the moveable bodies (12,13) are coupled to one another with the body (11) closest to the base, whereby by means of an attachment system (coupling of the flanges 24 in the cover 14 with the openings 23 in the fixed body 11: the loudspeaker is in the transporting position, occupying a minimum volume.

A series of gaskets 8 (O-rings in the particular case of the drawing) are used between the different bodies (11,12,13) of the casing 1 for sealing the air chamber inside the enclosure of the loudspeaker, such that the loudspeaker behaves like a closed enclosure regardless of whether the extendable casing 1 it being folded or unfolded.

Figure 3:
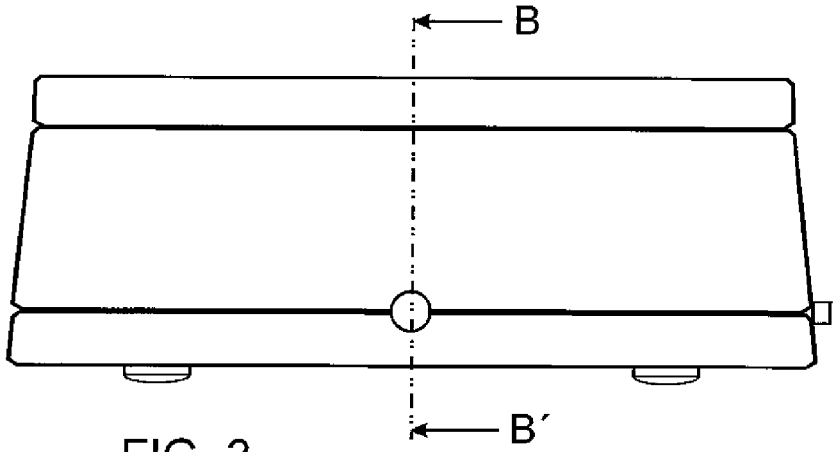
FIG. 3 shows an elevational view of the loudspeaker of the present invention in extended arrangement.
Figure 4:
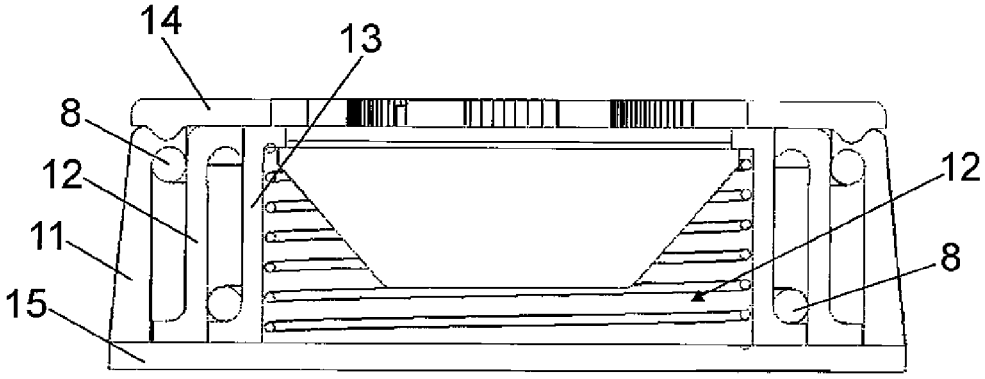
FIG. 4 depicts a cross-section view according to the cutting lines BB' indicated in FIG. 3, the loudspeaker being in retracted position.

FIG. 3 shows how the loudspeaker is in retracted position and FIG. 4 depicts a section according to the cutting lines BB' of FIG. 3.

Figure 5:
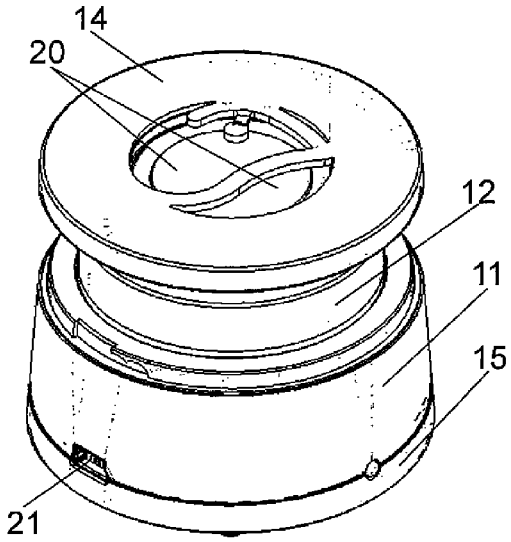
FIG. 5 depicts a three-dimensional view of the loudspeaker in open or extended position.

FIG. 5 shows a three-dimensional view of a possible embodiment of the loudspeaker, in this case a portable loudspeaker. The cover 14 of the loudspeaker has at least one wide opening 20 to allow the output of the sound outside the casing 1. The loudspeaker has an input connector 21 to receive the audio signal, normally coming from an audio player. The input audio signal can be from any number of channels (mono, stereo, digital, etc.).

Figure 6:
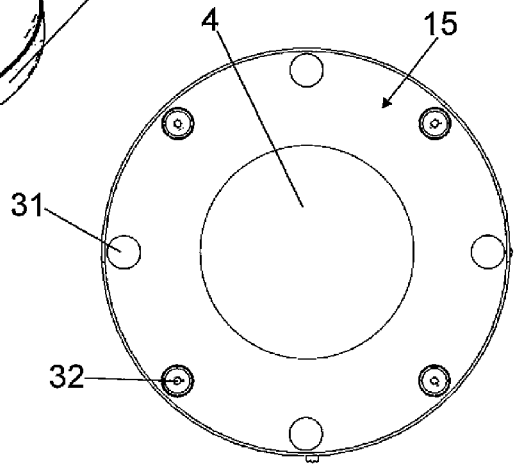
FIG. 6 shows a possible lower view of the loudspeaker.
Figure 7:
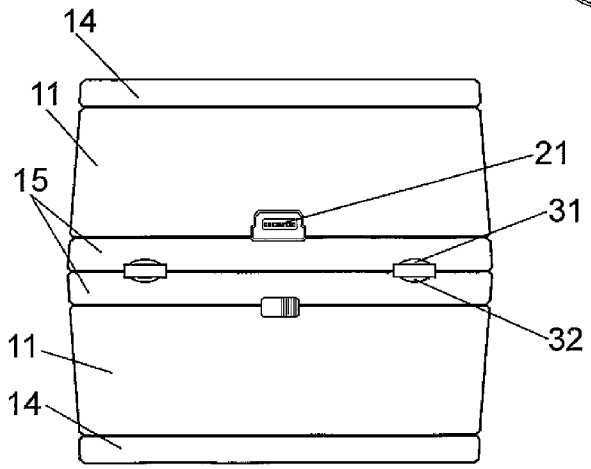
FIG. 7 depicts a pair of portable loudspeakers according to the present invention joined by their bases.

The loudspeaker can have a magnet 4 in its base 15 such as shown in the lower view of the loudspeaker depicted in FIG. 6 for its easy attachment on a ferromagnetic surface, for example, on the door of a refrigerator, or for coupling two portable loudspeakers by their respective bases. The loudspeaker shown preferably has a flexible material in its base 15, or the base 15 is formed by flexible material to insulate the loudspeaker from external or internal vibrations generated by the emitted sound when it is placed on any smooth surface. There can be flanges 32 and cavities 31 to facilitate the coupling between two portable loudspeakers by their respective bases in the base 15. FIG. 7 shows two portable loudspeakers according to the present invention joined by their bases 15 by means of the convenient coupling between flanges 32 and cavities 31 of the portable loudspeakers.

Figure 8:
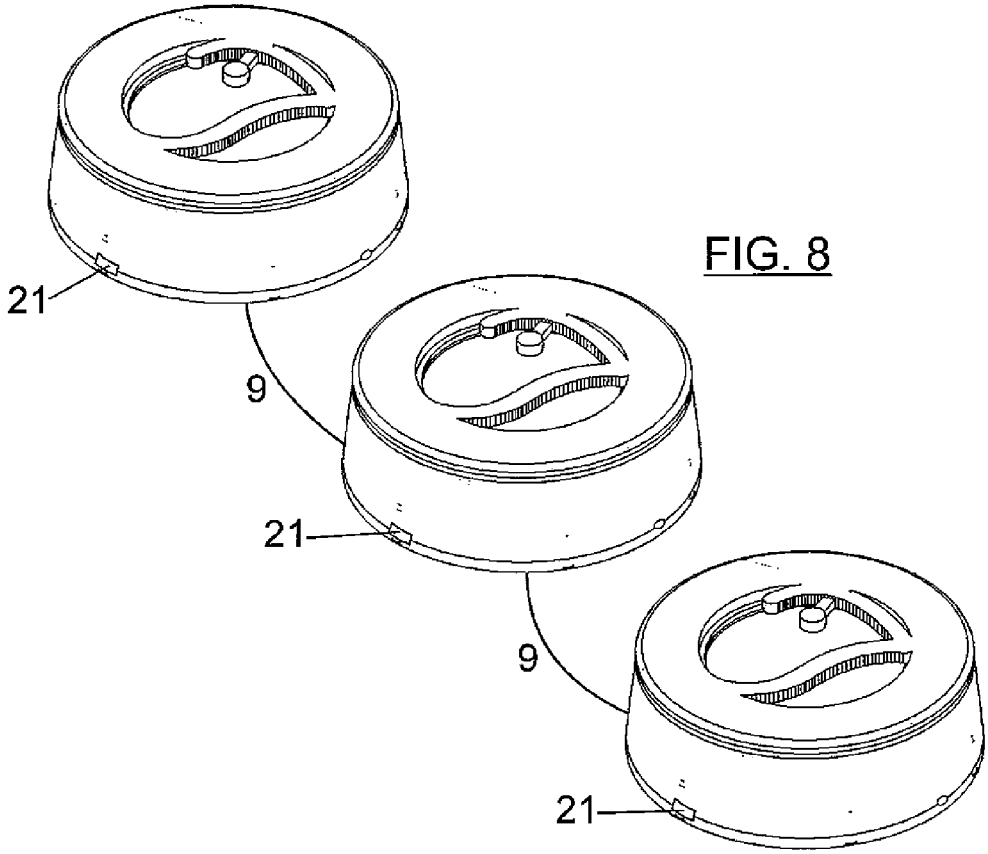
FIG. 8 shows a series of portable loudspeakers according to the present invention joined to one another by means of cables allowing their simultaneous use.

A plurality of portable loudspeakers can also be connected to one another in chain by means of cables 9 such as shown in FIG. 8 where the portable loudspeakers are depicted in retracted position, such that the combined sound is increased, acting as a single sound source. The loudspeakers are independent of the number of channels of the audio signal, for example, stereo signal is emitted through the connection cable, this signal can be decoded and played in each loudspeaker by means of an inner semiconductor circuit, allowing the unlimited connection of loudspeakers. To that end, each loudspeaker can have an output cable 9 through which the same audio signal received through the inlet connector 21 would be produced, said output cable 9 being connected to the input connector of another loudspeaker and thus respectively for forming a chain of portable loudspeakers of unlimited number.

Figure 9:
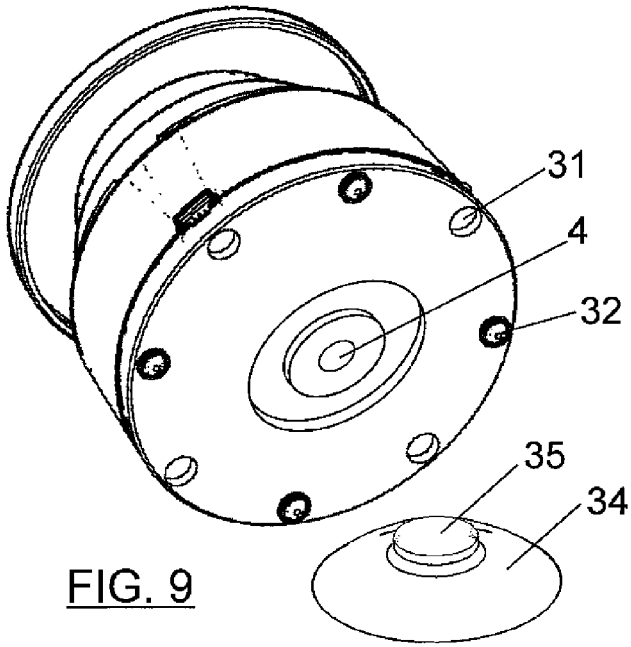
FIG. 9 shows the telescopic loudspeaker and the suction cup with magnet for the attachment of the loudspeaker on any surface.

The telescopic loudspeaker can also have, as shown in FIG. 9, a suction cup 34 incorporates a magnet 35 in its upper part to allow its attachment to the magnet 4 attached in the base 15 of the telescopic body (1) such that the loudspeaker can be attached on any flat surface. The suction cup could also be attached directly to the base 15 without the need of using the magnet 35.

Variations in materials, shape, size and arrangement of the component elements described in a non-limiting manner do not alter the essentiality of this invention, it being sufficient for the reproduction thereof by a person skilled in the art. For example, the extendable casing 1 can have any number of bodies provided that they are at least two. The transversal section of the bodies (11,12,13) of the casing 1 can likewise be another section different from the circular one shown in the drawings (square, octagonal, etc.). The number of moveable bodies (12,13) of the casing can also be variable, there must be at least one moveable body. The audio signal is received preferably through the connector 21, but it could also be received wirelessly therefore the loudspeaker would have a wireless audio received housed inside the casing.

The invention claimed is:

1. A portable telescopic loudspeaker comprising an extendable telescopic body configured for housing a loudspeaker for generating sound from an input audio signal and for creating an inner resonance chamber of volume $V_0$ when the telescopic body is retracted and of volume $V_1$ when the telescopic body is extended so that, $V_1>V_0$ said telescopic body comprising a support base, wherein the telescopic body is stiff and comprises a plurality of stiff hollow bodies with decreasing transversal sections and coupleable to one another, the section decreasing progressively from the body closest to the base up to the body furthest from the base.

2. The telescopic loudspeaker according to claim 1, wherein the telescopic body comprises a gasket between each pair of consecutive bodies of the telescopic body for sealing the air chamber inside the enclosure of the telescopic loudspeaker.

3. The telescopic loudspeaker according to claim 2, wherein the telescopic body further comprises a cover attached to the body furthest from the base, said cover having at least one opening to allow the output of sound outside the telescopic body.

4. The telescopic loudspeaker according to claim 3, further comprising attachment means for maintaining the telescopic loudspeaker in retracted position by the attachment of the cover to the body closest to the base.

5. The telescopic loudspeaker according to claim 4, wherein the attachment means comprise flanges in the cover and complementary openings in the body closest to the base.

6. The telescopic loudspeaker according to claim 2, wherein the transversal sections of the bodies of the telescopic body are circular.

7. The telescopic loudspeaker according to claim 2, additionally further comprising a magnet attached in the base of the telescopic body.

8. The telescopic loudspeaker according to claim 7, comprising a suction cup incorporating a magnet in an upper part to allow attachment to the magnet attached in the base of the telescopic body.

9. The telescopic loudspeaker according to claim 2, wherein the base and the extendable body closest to the same form a single body.

10. The telescopic loudspeaker according to claim 9, comprising an output connector for connecting to a connector of another telescopic loudspeaker by an output cable, the telescopic loudspeaker being configured to play the input audio signal through the cable.

11. The telescopic loudspeaker according to a claim 2, wherein the base has a plurality of flanges and cavities to allow the coupling with another loudspeaker through their respective bases.

12. The telescopic loudspeaker according to claim 2, wherein the loudspeaker is attached to the body furthest from the base.

13. The telescopic loudspeaker according to claim 1, further comprising a spring to maintain the telescopic body in extended position.

14. The telescopic loudspeaker according to claim 1, further comprising an input connector to receive the input audio signal.

15. The telescopic loudspeaker according to claim 1, comprising a wireless audio receiver configured to receive the input audio signal.

* * * * *